United States Patent [19]

Comstock, Jr.

[11] 4,174,573

[45] Nov. 20, 1979

[54] BLACK BOARD LINE MARKING DEVICE

[76] Inventor: George W. Comstock, Jr., P.O. Box 81, North Sioux City, S. Dak. 57049

[21] Appl. No.: 905,877

[22] Filed: May 15, 1978

[51] Int. Cl.[2] ..... B43L 13/00

[52] U.S. Cl. ..... 33/32 C; 33/41 R

[58] Field of Search ..... 33/26, 32 R, 32 B, 32 C, 33/35, 41 R, 41 D, 76, 79, 80

[56] References Cited

U.S. PATENT DOCUMENTS

| | | | |
|---|---|---|---|
| 561,585 | 6/1896 | Harris | 33/32 C |
| 668,957 | 2/1901 | Fletcher | 33/26 |
| 972,569 | 10/1910 | Nunamaker | 33/35 |
| 1,013,086 | 12/1911 | Winters | 33/26 |
| 1,186,716 | 6/1916 | Walker | 33/41 R |
| 2,861,343 | 11/1958 | Click | 33/41 R |
| 3,086,290 | 4/1963 | Kuehl | 33/41 |
| 3,363,319 | 1/1968 | Greer | 33/76 |
| 3,378,927 | 4/1968 | Lowery | 33/26 |
| 4,008,522 | 2/1977 | Anderson | 33/44 |

*Primary Examiner*—Harry N. Haroian
*Attorney, Agent, or Firm*—Howard I. Podell

[57] ABSTRACT

A desired marker such as a felt tip pen or a pencil or a chalk may be carried across a chalk board by mounting the marker on a clamp which is attached to an arm. The arm in turn can be mounted on a trolley which is movable on a frame. The frame can be attached to the chalk tray by wheels and a handle attached to the frame. The marker can be moved across the chalk board by moving the arm mounted on the trolley with respect to the general position of the frame. The frame can be moved using the wheels underneath the frame and the handle attached to the frame.

6 Claims, 5 Drawing Figures

BLACK BOARD LINE MARKING DEVICE

BACKGROUND OF THE INVENTION

I have invented a new and novel black board line marking device. My improved marking device uses a felt tip pen to line a chalk board or slate black board with suitable guide lines for use by students. The adjustable holder for the felt tip pen can be used to accommodate a pencil or a chalk as the line marking tool. Furthermore, the device can run on the chalk board eraser tray to serve as a base guide. This improved black board line marking device can save time and provide less errors than the prior art.

Prior art references known at the time of preparation of this application include the following patents: U.S. Pat. Nos. 4,008,522; 3,378,927; 3,363,319; 3,086,290; 668,957; and 561,585.

BRIEF DESCRIPTION OF THE INVENTION

My improved black board marker uses a frame which runs on wheels which can travel along a chalk board tray to guide a marker attached by a clamp to a vertical arm which is attached to a trolley. The trolley runs on a frame with the wheels. A handle on the frame permits moving of the frame as needed.

BRIEF DESCRIPTION OF THE FIGURES:

My invention can be understood in view of the accompanying figures.

DETAILED DESCRIPTION OF THE PREFERRED EMBODIMENT

Figure 1:
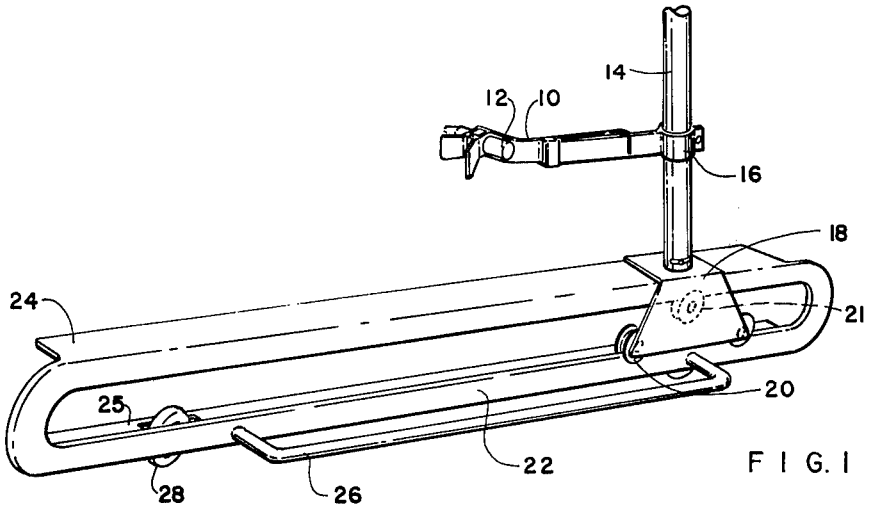
FIG. 1 is a perspective view of the device.
Figure 2:
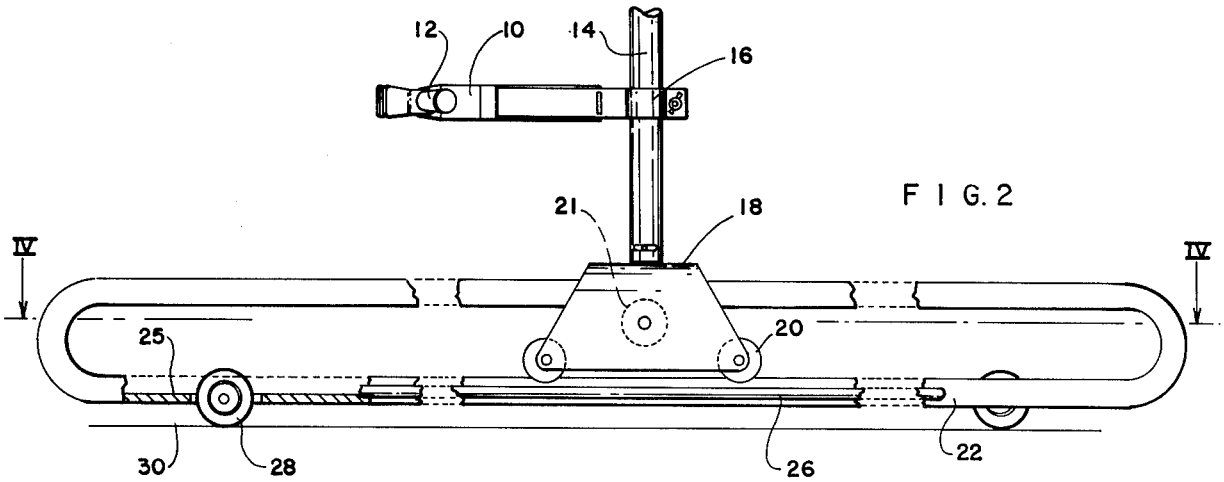
FIG. 2 is a front view of the device mounted on a chalk tray.
Figure 3:
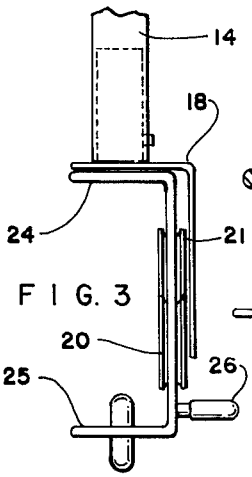
FIG. 3 is a side view of a portion of the device.
Figure 4:
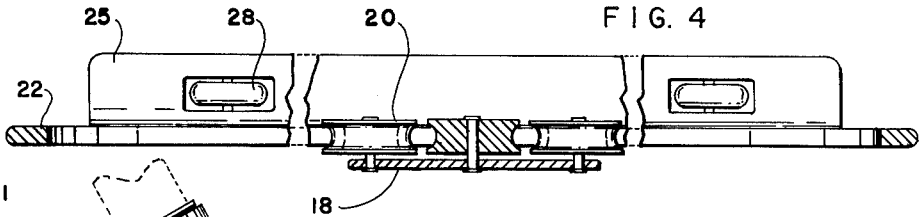
FIG. 4 is a view taken along the plane 4–4 of FIG. 2 of the device.
Figure 5:
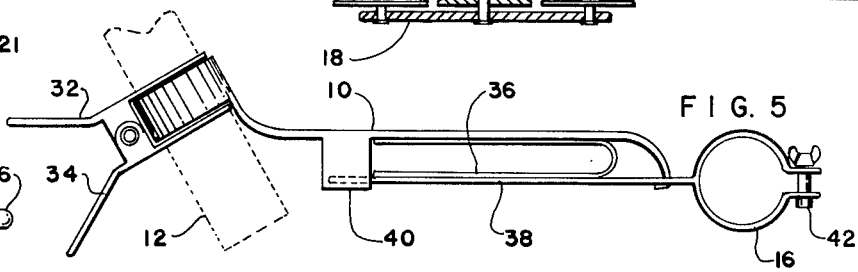
FIG. 5 is a top view of the clamp and attachments.

With regard to FIGS. 1, 2, 3, 4 and 5, a clamp 10 can hold a marker 12 on an arm 14 using an adjustable attachment 16. The arm 14 can travel on a trolley 18 which is attached by lower trolley wheels 20 and upper trolley wheel 21 to a frame 22. Trolley platforms 24 and 25 guide the trolley 18 which can be moved by handle 26 and frame wheels 28 as needed along the chalk tray. Spring loaded clamp members 32 and 34 can hold the individual marker 12 while folded spring 36 between the clamp mount 38 and the clamp 10 is secured by clamp arm catch 40 to the clamp mount 38. Clamp mount 38 in turn is mounted on the adjustable attachments 16 which is secured at the desired level on the arm 14 by the nuts and bolts 42.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A board line marking device comprising
a frame fitted with a plurality of wheels,
a trolley fitted with a plurality of wheels,
an arm mounted on said trolley,
clamp means of fastening a marker fitted to said arm,
said trolley mountable on said frame so that the wheels of the trolley rest on and are in rolling engagement with a straight surface of the frame, with the wheels of said frame located so as to rest in rolling engagement on a horizontal chalk tray that extends from a vertical board, when a marker is fastened in said clamp means and located so as to extend to the surface of said vertical board for the purpose of marking said board.

2. The invention as recited in claim 1 in which the said straight surface of the frame on which the trolley wheels rest, extends along a plane parallel to the plane of a said chalk tray in the position of use.

3. The invention as recited in claim 1 in which the said clamp means are fitted to the said arm so as to be adjustably fixed in one of a plurality of positions along the length of said arm.

4. The invention as recited in claim 3 in which the arm extends in a generally vertical direction when the frame is mounted in the position of use on a chalk tray.

5. The invention as recited in claim 1 in which the frame is formed with a slot, with a first edge of said slot forming the straight surface of the frame on which the wheels of the trolley rest.

6. The invention as recited in claim 5 in which the trolley is formed with two sets of wheel or wheels located so that the first set of wheel or wheels rest on and are in rolling engagement with a first straight edge of the slot of the frame and a second set of wheel or wheels rest on a second straight edge of the slot, with said second edge being opposed to and substantially parallel to the said first straight edge, and with one of said sets of wheels including at least two wheels and the other set of wheels including at least one wheel so that said trolley is restrained from motion in the direction perpendicular to said slot straight edges but the wheels of the trolley are free to roll in the direction of said edges within said slot.

* * * * *